US005273175A

United States Patent [19]

Apps

[11] Patent Number: 5,273,175

[45] Date of Patent: Dec. 28, 1993

[54] SPLIT BOX CASE CONSTRUCTION

[75] Inventor: William P. Apps, Anaheim, Calif.

[73] Assignee: Rehrig Pacific Company, Inc., Los Angeles, Calif.

[21] Appl. No.: 10,198

[22] Filed: Jan. 28, 1993

[51] Int. Cl.[5] ..... B65D 6/04

[52] U.S. Cl. ..... 220/23.4; 206/203

[58] Field of Search ..... 220/23.4, 23.6, 4.27; 206/203

[56] References Cited

U.S. PATENT DOCUMENTS

| | | | |
|---|---|---|---|
| 2,732,969 | 1/1956 | Browne | 220/23.4 |
| 3,131,829 | 5/1964 | Masser | 220/23.4 X |
| 3,317,081 | 5/1967 | Cornelius | 220/102 |
| 3,341,053 | 9/1967 | Keene | 220/23.4 X |
| 3,343,705 | 9/1967 | Erickson | 220/23.4 |
| 3,404,805 | 10/1968 | Stockman et al. | 206/203 X |
| 3,616,943 | 11/1971 | Brink | 214/10.5 |
| 4,328,902 | 5/1982 | North | 220/23.4 |
| 4,387,824 | 6/1983 | Wefers | 220/23.4 |
| 4,548,320 | 10/1985 | Box | 206/509 |
| 4,770,297 | 9/1988 | Chang | 220/23.4 X |
| 4,789,075 | 12/1988 | Sun et al. | 220/4 |
| 4,790,443 | 12/1988 | Auer | 220/23.4 |
| 5,078,292 | 1/1992 | Cremer | 220/23.4 |
| 5,101,969 | 4/1992 | Umiker | 206/144 |
| 5,105,962 | 4/1992 | Götz | 220/23.4 |

FOREIGN PATENT DOCUMENTS 3922102A 1/1991 Fed. Rep. of Germany .

OTHER PUBLICATIONS

Advertising brochure of Split-Box Vertriebsgesellschaft MBH, Komödienstrasse 48, 5000 Köln, Germany, entitled "Split Box—das tolle Marketing-Instrument!".

Advertising notice of Schoeller Plast GmbH, 4000 Düsseldorf-Gerresheim, Germany entitled "Brauwelt 37".

Advertising notice of Oberland Plastic GmbH Industriestrasse D-7954 Bad Wurzach, Germany, entitled "Twin-Box—Zwei Teile, eine Idee".

*Primary Examiner*—Steven M. Pollard

*Attorney, Agent, or Firm*—Banner, Birch, McKie and Beckett

[57] ABSTRACT

A case construction for containers includes separable, identically configured, compartmentalized box units having connecting elements on interfacing side walls in the form of tubular elements comprising male and female segments in which those on one box unit telescopically cooperate with corresponding segments on an associated box unit to restrict relative movement between the box units in longitudinal and transverse direction and also serve to restrict movement of containers disposed in the compartments. A latch member is carried by one end wall of each box unit and is movable along tracks between a latching position straddling the connected box units and an unlatching position permitting separation thereof. The bottom wall of the box units contain ribs forming a channel network that enables optional column- or cross-stacking of the case constructions.

40 Claims, 8 Drawing Sheets

SPLIT BOX CASE CONSTRUCTION

BACKGROUND OF THE INVENTION

The present invention relates to cases for the storage and transport of beverage containers. More particularly, the invention concerns a container case construction comprising paired, releasably connected box units of identical construction and an improved latching and connection structure for such box units.

Container cases of the concerned type are known for handling beverage containers, particularly bottles, intended for the self-service retail trade. In such form of case construction, the bottles can be loaded for transport, storage and display in cases handling, for example, twenty-four bottles and, thereafter, divided in half at the store because the purchaser desires only the reduced quantity represented by half the case. Such container cases are shown, for example, in U.S. Pat. No. 5,101,969, granted Apr. 7, 1992 to H. Umiker and U.S. Pat. No. 5,105,962, granted Apr. 21, 1992 to W. Götz. These prior art case constructions possess certain undesirable characteristics which are addressed by the present invention. For example, the case construction described in U.S. Pat. No. 5,101,969 possesses connection and latching mechanisms that are formed of relatively weak structural members and located internally of the construction where they are readily subject to damage. The case construction described in U.S. Pat. No. 5,105,962, on the other hand, requires transverse relative movement for separating the box units from one another, which form of movement may be difficult to achieve when loaded cases care stacked one upon the other in a retail outlet.

It is to the amelioration of these problems and to the achievement of other advantages to which the present invention is directed.

SUMMARY OF THE INVENTION

According to the invention, therefore, there is provided a case construction comprising a pair of independent box units adapted for separable interconnection, said box units each having a generally rectangular bottom wall and opposed side and end walls upstanding from said bottom wall to define an open top; each of said box units having side walls carrying connectors cooperable with those on the other box unit to restrict relative movement between said box units in directions parallel to longitudinal and transverse axes of said box units, while permitting relative movement therebetween in a direction substantially perpendicular to said longitudinal and transverse axes; and latching means carried by the end walls of each box unit including mutually alignable track means carried by adjacent end walls of united box units, and a latch member carried by the end wall of at least one of said box units and slidable along said track means between an unlatching position enabling relative movement in a direction perpendicular to said longitudinal and transverse axes and a latching position preventing such relative movement.

Box units according to the invention are advantageously formed of molded plastics material and are of identical configuration. They utilize connectors in the form of integrated male and female columnar components that are structurally sturdy and that are readily interconnected or released by telescoping, movement between corresponding elements in the paired box units. For releasably joining a pair of box units, each box unit possesses a latch plate slidable along tracks arranged so that, when the box units are interconnected to form a case construction, a latch plate is rendered operative at opposite ends of the construction to positively prevent inadvertent relative movement between the respective box units.

It is therefore a principal object of the invention to provide a container case employing separable box units of improved construction that permits them to be readily connected and disconnected to enable the sale of container goods in lots of either paired or single box units.

It is another object of the invention to provide box units for such case construction that are of identical configuration and that are formed of molded plastics material into a sturdy structure resistant to physical damage and deterioration.

A further object of the invention is to provide an improved connector organization for box units for such case construction comprising a plurality of longitudinally spaced connectors that produce a sturdy construction and that enable the box units to be easily interconnected and disengaged in order to render the construction particularly suitable for the self-service retail trade.

Yet another object of the invention is to provide an improved latch mechanism for such case construction that is easily operable and that is effective to prevent inadvertent disconnection of united box units.

Still another object of the invention is to provide a box unit for a case construction of the concerned type that is of simple design and inexpensive to produce, yet sturdy and dependable in operation.

A still further object of the invention is to provide a box unit for a case construction that lends itself to both column- and cross-stacking.

For a better understanding of the invention, its operating advantages and the specific objectives obtained by its use, reference should be made to the accompanying drawings and description which relate to a preferred embodiment thereof.

DESCRIPTION OF A PREFERRED EMBODIMENT OF THE INVENTION

Figure 1:
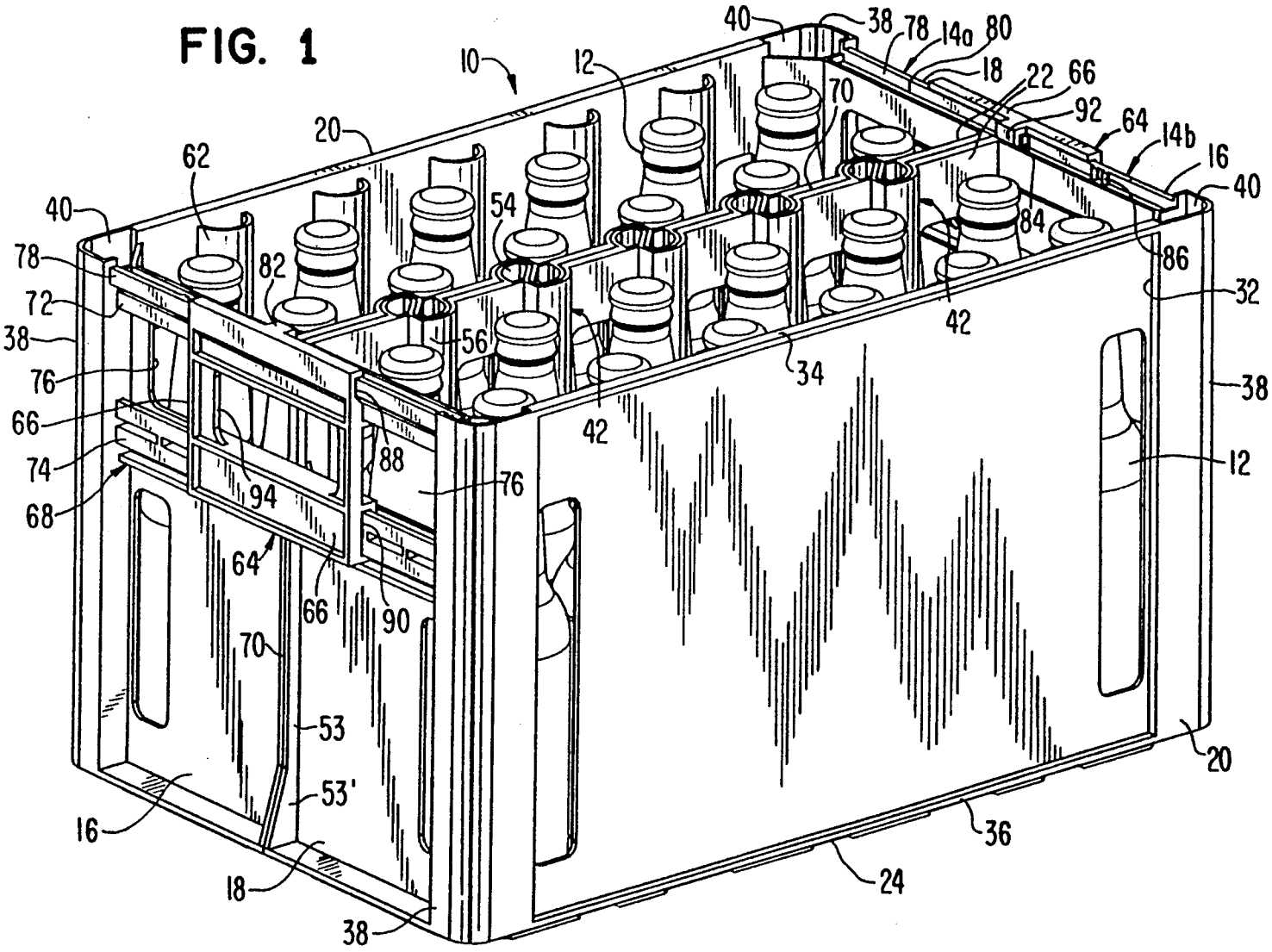
FIG. 1 is a top perspective view of a fully loaded case construction according to the present invention.
Figure 2:
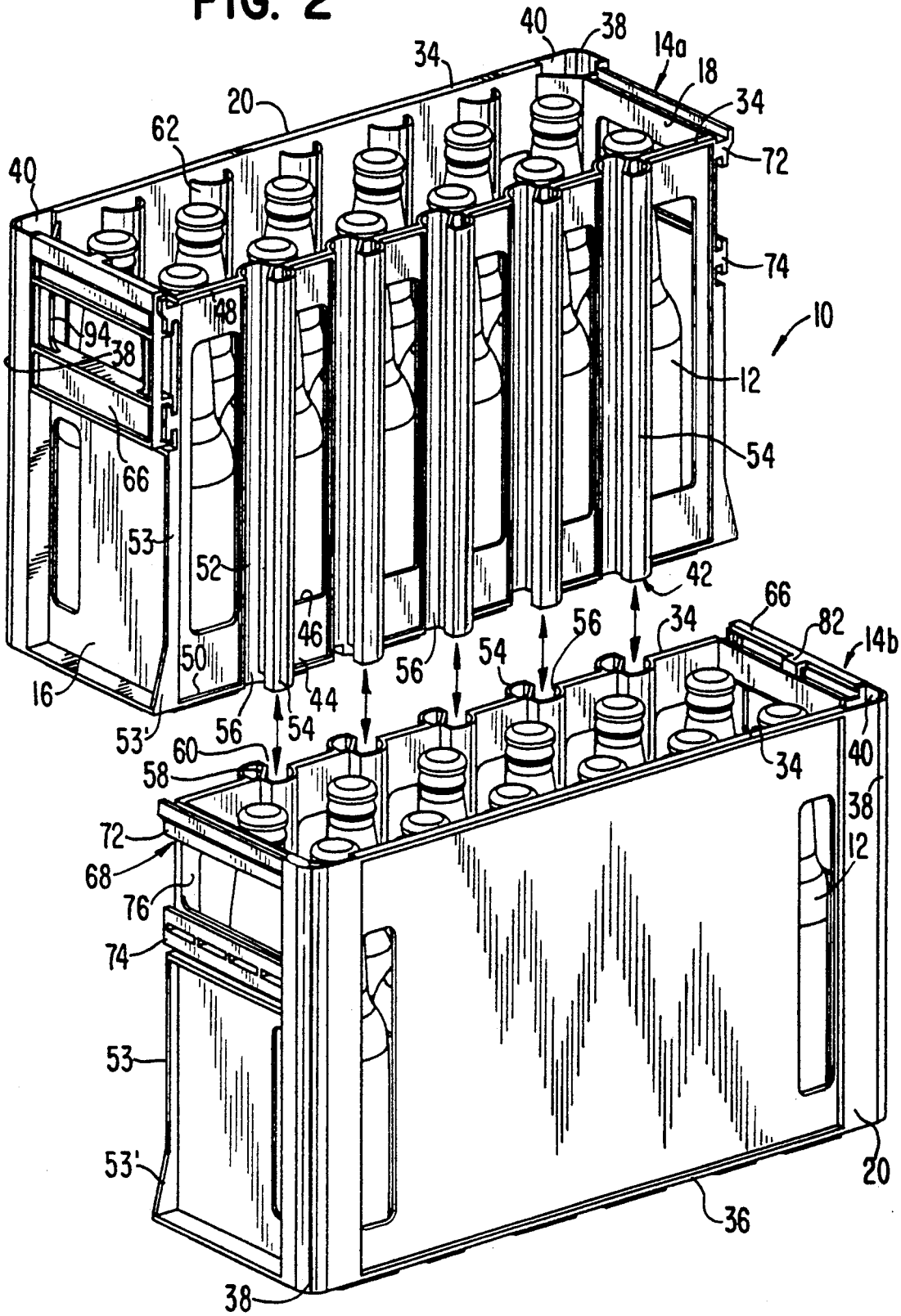
FIG. 2 is a perspective view of the box units of the present invention illustrating their manner of joinder into the case construction of the invention.

Referring to the drawings there is shown, by way of example, a case construction, indicated generally as 10, according to the present invention which is particularly adapted for reception of beverage bottles 12. Case 10 comprises a pair of box units 14 which are separably interconnected and which, for purposes of identification, are designated in the drawing figures as 14*a* and 14*b*. The box units 14*a* and 14*b* are of identical construction with each being designed, as shown, to hold twelve bottles. Thus, where two box units 14 are interconnected as shown, the resultant case 10 holds twenty-four bottles, the typical full complement of a beverage case, consisting of a pair of interconnected box units 14. In practice, a case 10 is filled at the bottling plant and, thence, delivered to a retail outlet, typically of the "self-service-type" where the cases are stored in stacked array. It will be apparent that, due to the separable nature of the case construction, should a purchaser wish to buy only half a case, or twelve bottles, a pair of box units 14 need only be disconnected from each other for sale of only a single separated unit. Because the box units 14 are of identical structural configuration, they are readily interchangeable wherein any unit can be connected with any other unit.

The box unit 14, a typical one of which is shown in FIGS. 4 through 8, is preferably formed of molded plastic materials. With particular reference to these drawing figures, each box unit 13 comprises rectangularly disposed integrated end and side walls 16 through 22, with the end walls 16 and 18 being essentially mirrored images of each other and the side walls, identified as exterior wall 20 and interior wall 22, each containing diverse configurations as hereinafter more fully explained. The bottom 24 of the box unit 14 is closed by a grid-like structure and the top is open.

Figure 8:
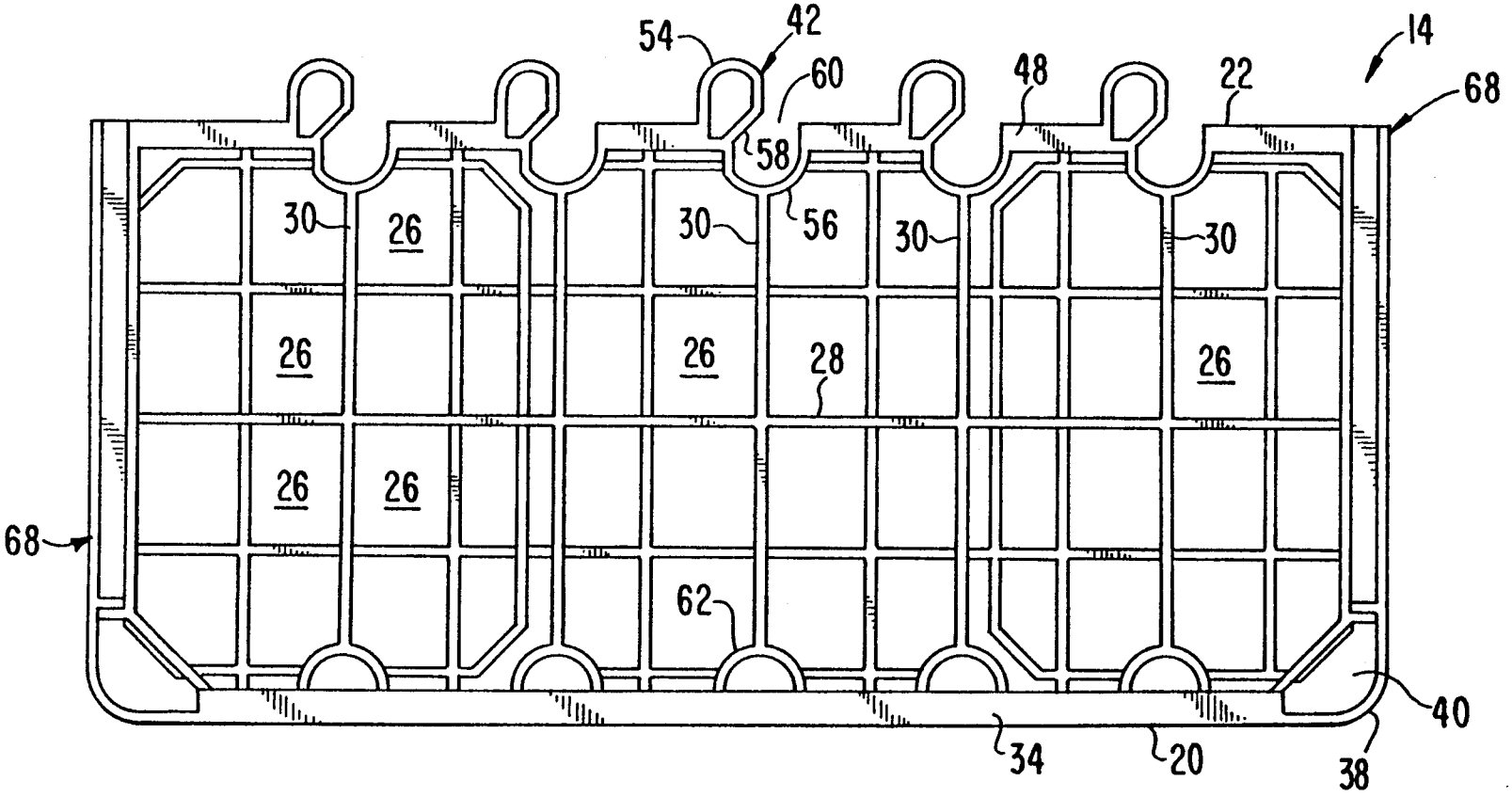
FIG. 8 is a top plan view of the box unit of FIG. 4.

As shown best in FIG. 8, the interior region of the box unit 14 is divided into container compartments 26, shown as being twelve in number, by a single longitudinal partition 28 which extends centrally of the region and laterally extending transverse partitions 30.

The exterior side wall 20 may, as shown, be formed of a continuous impervious surface in order to accommodate a label or product advertising. In the described embodiment, wall 20 is provided with a rectangular recessed portion 32 for this purpose, as well as to reduce the material requirement for the formation of the wall, except at the periphery thereof which is defined by horizontally extending upper and lower rims 34 and 36, respectively, and upstanding comer columns 38. As shown at 40, the columns 38 are preferably hollow in order to impart resiliency to the members in these areas of the unit, thereby to provide a cushioning effect that enhances the durability of the box units.

The interior side wall 22 of the box unit 14 is desirably formed of the same height as the other walls 16 to 20 and contains a plurality of longitudinally spaced tubular elements 42 that form the connector structure employed to join a pair of box units 14 into case construction 10. The wall 22 comprises a plurality of reduced thickness wall portions 44 disposed intermediate the respective tubular elements 42. The wall portions 44 may contain openings 46 for further weight reduction purposes and a peripheral reenforcing rim structure comprising opposed upper and lower rim segments 48 and 50, respectively, as well as upstanding side segments 52. As shown, opposite ends of the interior side wall 22 contain an additional upstanding rim 53 that terminates at its lower end in a gusset 53' in order to extend the interfacing surface area of the wall.

The tubular elements 42 desirably extend the full height of the interior side wall 20 perpendicularly between the upper and lower ends of the wall. Each element 42 comprises a pair of members 54 and 56, respectively, having walls formed as an arcuate segment. The wall of the member 54, termed the male member, extends outwardly from the interior side wall 22 and is formed as an arc whose radius is less than that of the arc forming the female member 56 which extends inwardly from the interior side wall. The radius of the wall forming male member 54 is reduced from that forming the female member 56 by an amount that enables the male members on one box unit to be snugly slidingly received in telescoping fashion into the female members of corresponding tubular elements on another box unit whereby the respective box units can be interconnected to form the case construction 10.

As shown best in FIG. 8, the respective male and female members 54 and 56 in each tubular element 42 is separated by a strut 58 or wall segment that is angularly displaced from the side wall proper by about forty-five degrees. The strut 58 closes each male member 54 while the female members 56 each contain an open space 60 that enables reception of male members 54 of a paired box unit 14 to be telescopically received in the respective female members.

The result of a connection organization employing the described tubular elements 42 is that an extraordinarily strong interconnection between associated box units 14 can be effected notwithstanding the fact that the interior side wall is a relatively light member due to the formation of the interior wall portions 44 of a reduced thickness and containing openings 46. Furthermore, it will be appreciated that, because the female members 56 are caused to extend inwardly from the interior side wall 22 and due to the joinder of the transverse partitions 30 with the mid-face of the walls forming these members, the members can provide a shimming or restraining effect on bottles 12 contained in the adjacent compartments 26. In order to provide a similar restraining effect on bottles 12 contained in compartments 26 adjacent the exterior side wall 20, the inside surface of that wall is desirably provided with upstanding semi-cylindrical stiffeners 62 which may extend the full height of the wall and that connect the opposite ends of the respective transverse partitions 30.

Latching mechanisms, indicated generally in the drawings as 64, are employed to positively lock the interconnected box units 14 together and thereby prevent their inadvertent separation. Such mechanisms are an integral part of each of the individual box units so that, upon interconnection of the paired units, a latching mechanism 64 win be operative at each end of the resultant case construction 10. Each latching mechanism 64 comprises a movable latch plate 66 that is slidable along a track structure 68 which extends transversely across the upper part of the end walls 16 and 18 of the paired box units 14*a* and 14*b*. The latching function thereby produced is effected when the latch plates 66 at one or both ends of the case construction 10 are moved to a position, termed the "latching position," which overlies the seam, indicated as 70, between the interior side walls 22 of the interconnected box units 14*a* and 14*b*.

Figure 4:
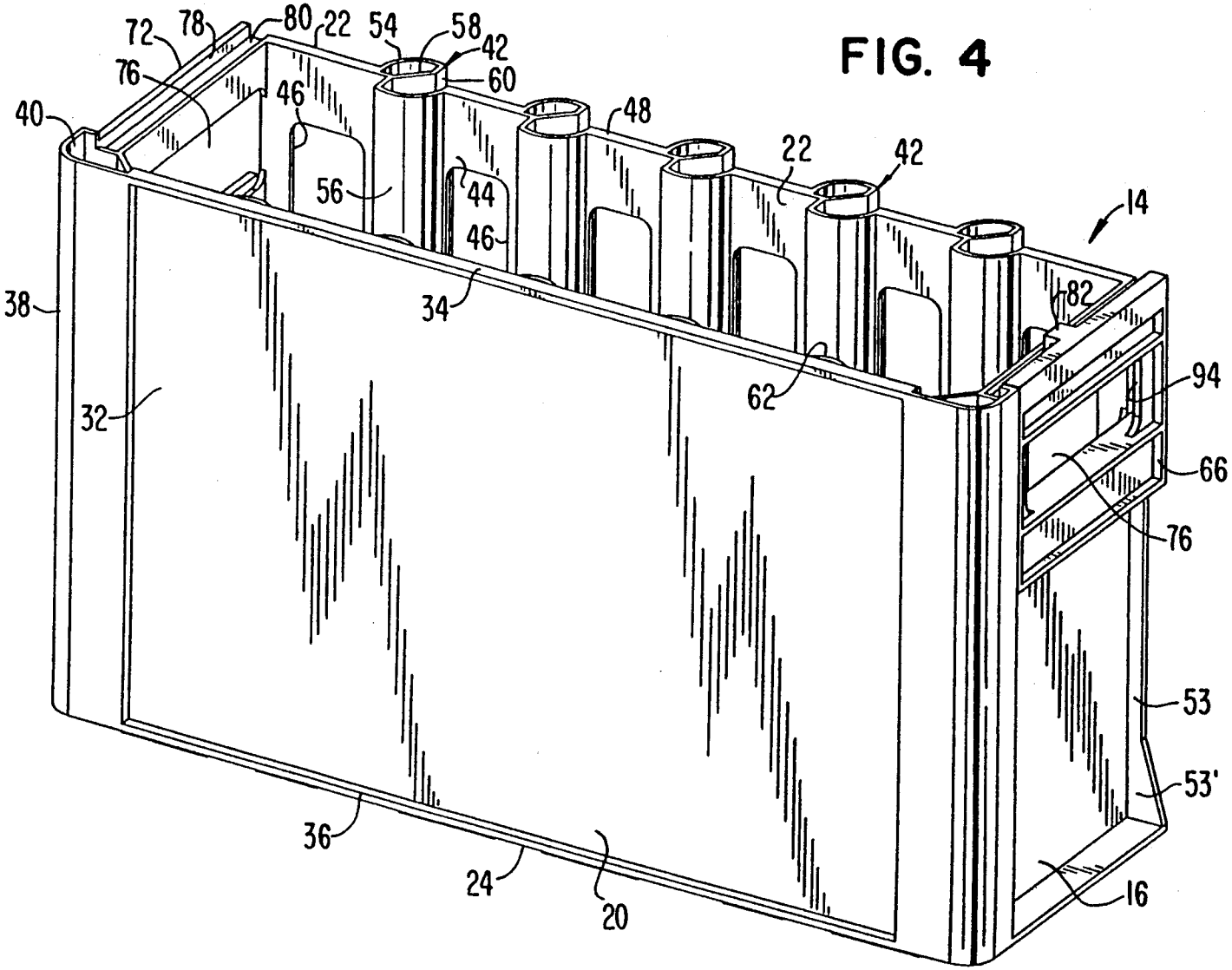
FIG. 4 is a top perspective view of a typical box unit of the present invention.
Figure 5:
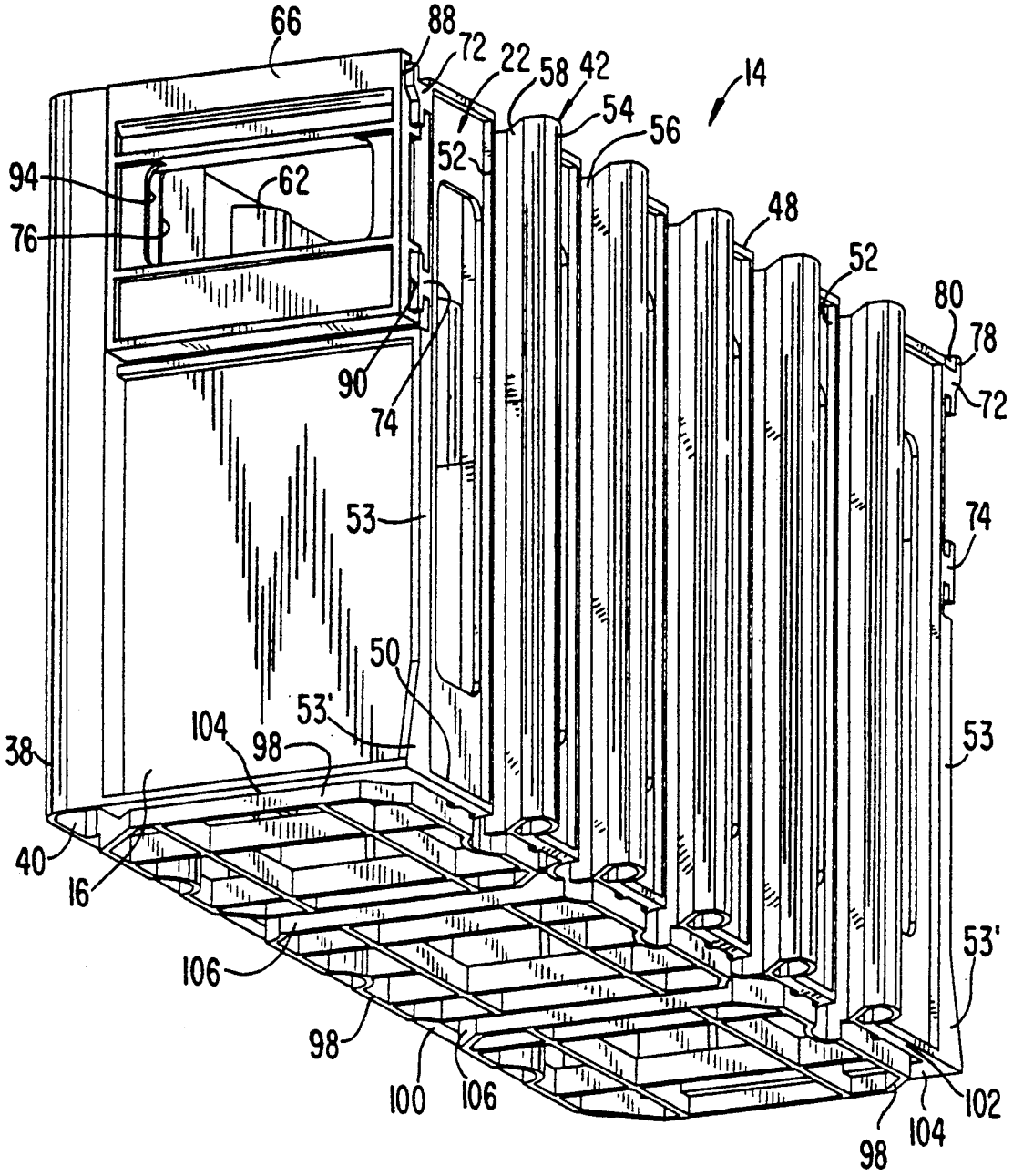
FIG. 5 is a bottom perspective view of the box unit of FIG. 4 shown from the opposite side.
Figure 6:
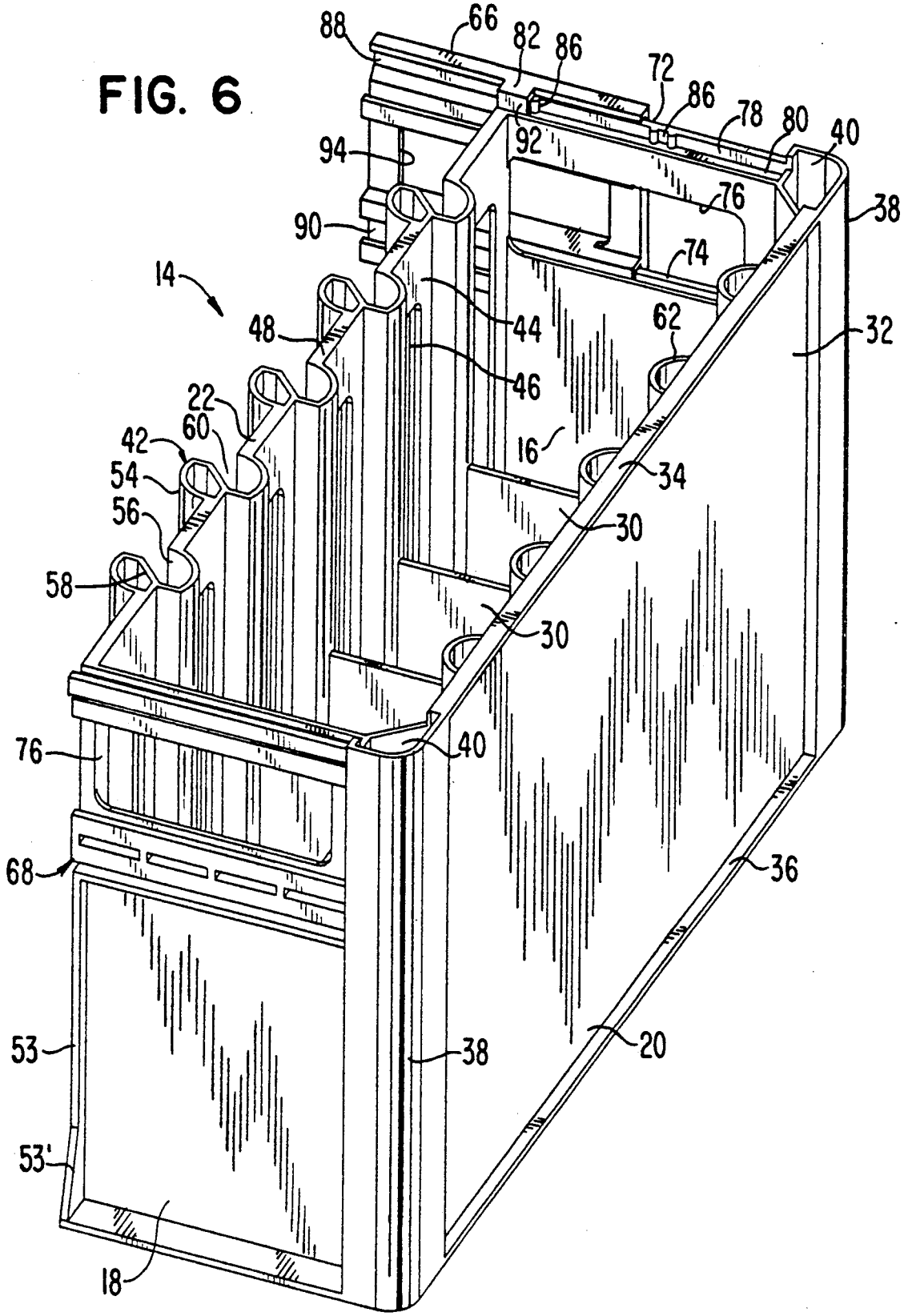
FIG. 6 is a top perspective view of a box unit illustrated from a different perspective from that of FIG. 4.
Figure 7:
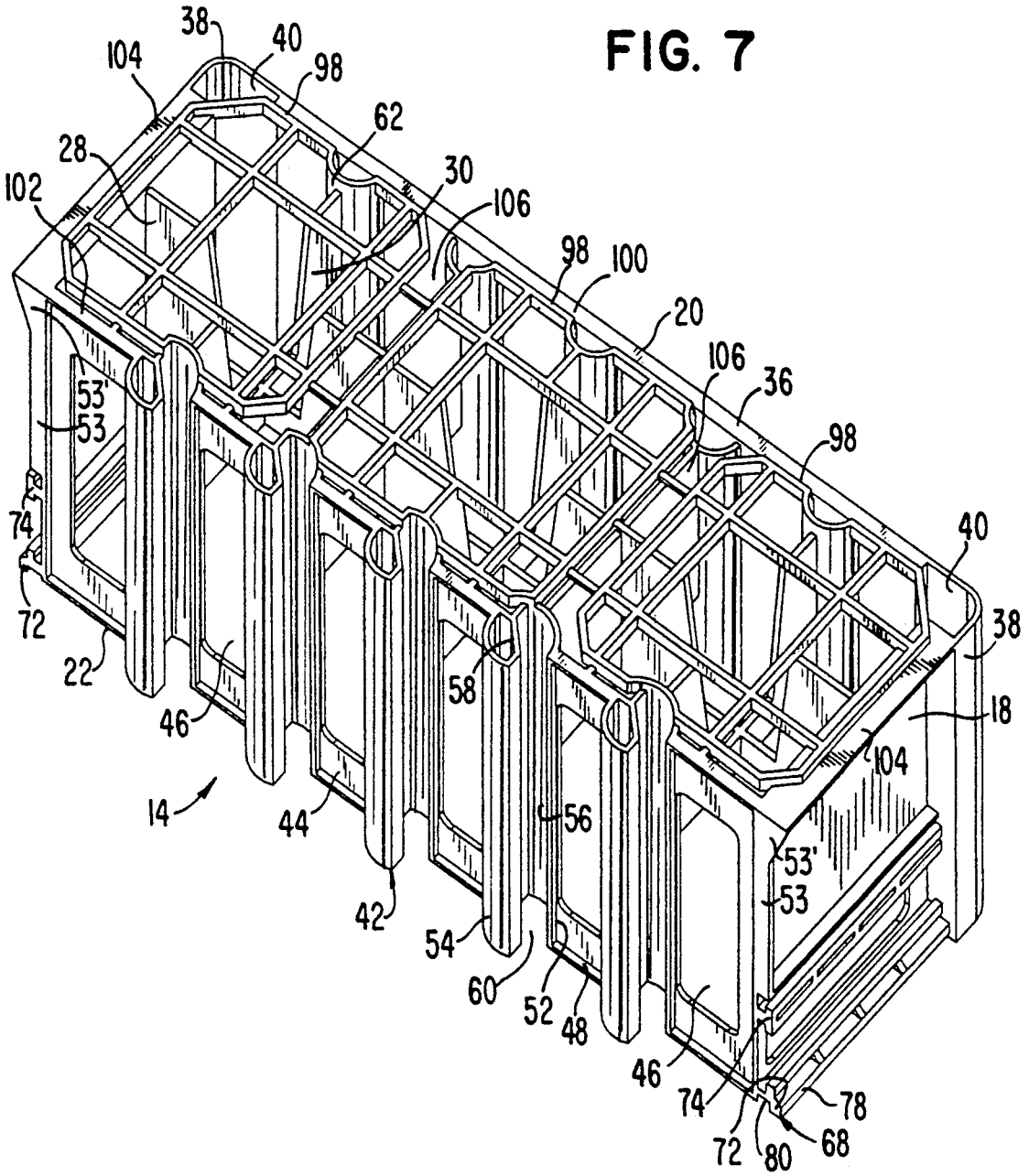
FIG. 7 is a bottom perspective view of the box unit of FIG. 4 illustrated from a different perspective from that of FIG. 5.

The latching mechanism 64 is best described with reference to FIGS. 3, 4 and 5 in which each box unit 14 is shown as being provided with a track structure 68 integrally formed in the opposite end walls 16 and 18 at the upper part thereof. The track structure includes an upper track 72 which is operatively positioned adjacent the upper rims 34 of opposite end walls 16 and 18 and extend transversely across the end walls parallel to the upper rim. A lower track 74 is spaced downwardly from the upper track 72 and extends parallel thereto. Handle openings 76 are formed in the end walls 16 and 18 between the tracks 72 and 74 to enable grasping of the separated box units at each end. While the lower track 74 possesses the shape of a conventional T-section, the upper track 72 has the upper flange 78 offset outwardly from the upper rim 34 to define an enlarged recess 80 for disposition of position-determining detents and reception of a clasp portion 82 formed on the latch plate 66.

Figure 3:
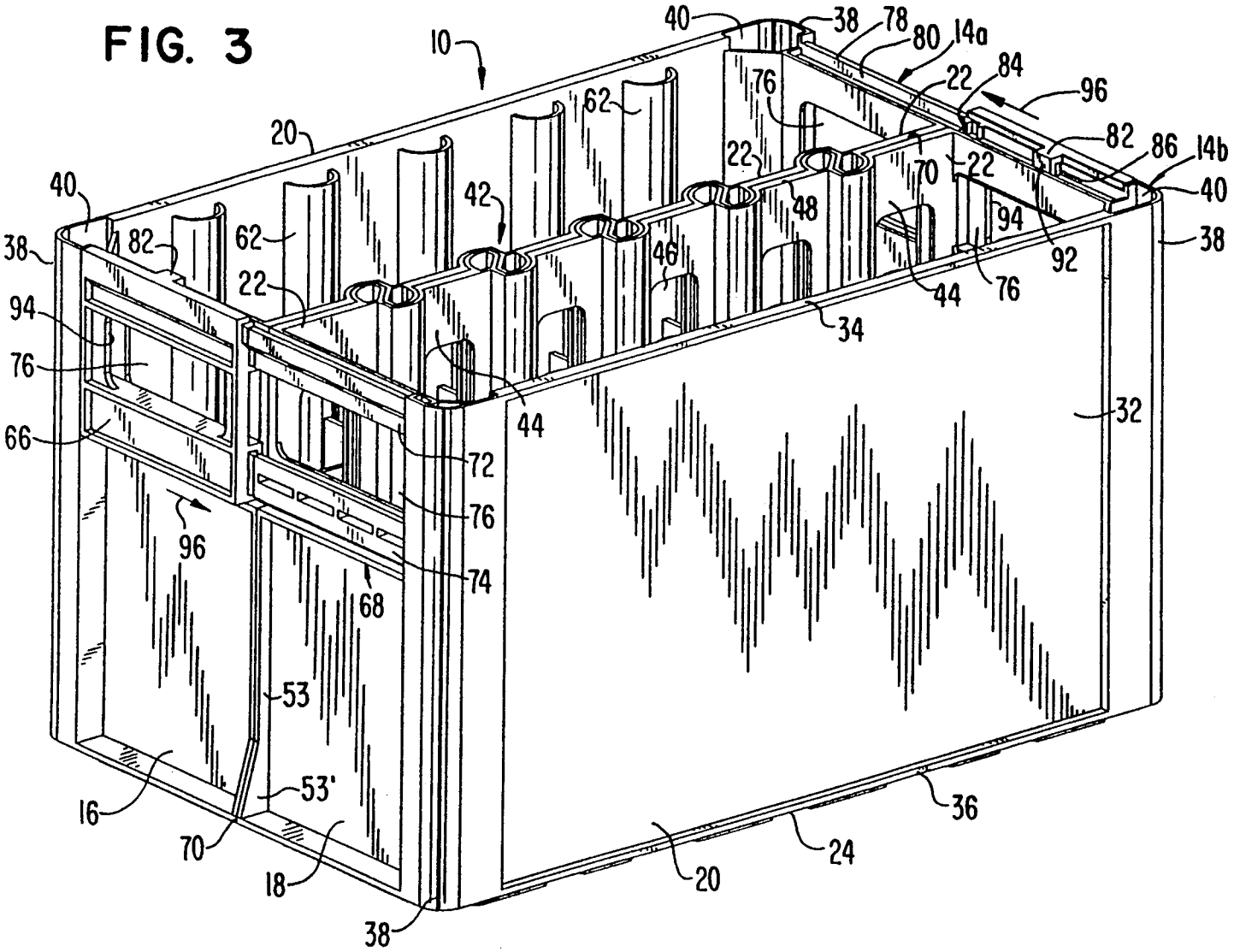
FIG. 3 is a top perspective view of an empty case construction according to the present invention illustrating the manner of operation of the latching mechanism of the invention.

The tracks 72 and 74 at opposite ends of the box unit are correspondingly shaped and positioned so that, when the box units indicated as 14*a* and 14*b* in FIG. 3 are placed in paired, interconnected relation, the respective tracks 72 and 74 on the adjacent end walls 16 and 18 of the respective box units are disposed in transverse alignment so as to extend the track structures 68 at opposite ends of the resultant case construction 10 continuously across the width thereof.

As shown in FIG. 3, the recess 80 in the upper track 72 on end wall 16 is provided with two longitudinally spaced position stops 84 and 86 representing the "latched position" and "unlatched position," respectively, for the latch plate 66. Each of the stops 84 and 86 is formed by a pair of spaced upstanding detents 88 which extend part-way across the width of the recess 80 and which each may be formed with a semi-cylindrical surface to facilitate reception of a similarly formed single detent (not shown) provided in the clasp portion 92 of the latch plate 66.

The latch plate 66 is carried by only one end wall of each box unit 14, here shown as end wall 16. As shown, the latch plate 66 has a generally rectangular body that possesses, on its back side, flanges defining appropriately formed track-follower grooves 88 and 90 for slidable reception on the respective tracks 72 and 74. The clasp portion 82 of the latch plate 66 is disposed intermediate the ends of the body and is defined by an inverted, generally U-shaped flange 92, the vertical wall of which is formed with a detent that cooperates with the detents forming the position stops 84 and 86 to enable accurate positioning of the latch plate 66 in its "latched" and "unlatched" positions, respectively.

So as not to obstruct or interfere with the handle openings 76 in the end walls 16 and 18 of the box units 14, the latch plate 66 is formed with a hand opening 94 that, with the plate located in the "unlatched" position, registers with the handle opening 76 in the adjacent end wall 16 to enable the box unit to be effectively grasped at both ends. Alternatively, when the latch plates 66 are moved in the direction of the arrows 96 shown in FIG. 3 to place them across the seam 70 in the "latched" position whereby relative movement between the interconnected box units 14*a* and 14*b* is prevented, the hand opening 94 in the respective latch plates 66 is caused to straddle the abutting interior side walls 22 of the box units placing the opening in communication with parts of both of the handle openings 76. In this way, the completed case construction 10 can be grasped in central regions of its ends permitting a full case to be lifted in a balanced condition.

Case constructions 10 according to the invention are, as is usual for cases for bottled beverage containers, provided with peripheral dimensions having a length-to-width ratio of about 3-to-2. Consequently, each of the box units 14 is constructed with peripheral dimensions of about 3-to-1 in which the side walls 20 and 22 are about three times as long as the end walls 16 and 18 so as to produce the desired 3-to-2 length-to-width ratio when two box units are assembled into a completed case construction.

In order to facilitate stacking, therefore, the disclosed case construction 10 incorporates structure on the bottom of the box units 14 so-designed as to enable stacking of assembled case constructions 10 either in a column-stacking or a cross-stacking mode. As is well known, in a column-stacking mode, the cases are simply superimposed one upon the other in column array so that on a pallet, or the like, the cases appear as a plurality of vertical columns. In the cross-stacking mode, on the other hand, cases in alternate layers of a pallet load are angularly displaced by ninety degrees with respect to the cases in the subjacent layer thus imparting greater stability to the load. Accordingly, in order to facilitate both modes of stacking, the grid-like structure forming each box unit bottom 24 is provided with a strut organization defined by a series of raised portions 98, here shown as being octagonal in shape, that are spaced inwardly from the lower rims 36 of the end walls 16 and 18 and exterior side wall 20, and from the lower rim segments 50 of the interior side wall 22, as well as being mutually spaced from each other thereby to define a case-positioning channel system. The so-defined channel system is effective to positionally receive the upper rim 34 of a subjacent case construction 10 in a stack and includes rectangularly arranged longitudinal channels 100 and 102 extending parallel to side walls 20 and 22, respectively; transverse channels 104 extending parallel the end walls 16 and 18; and interior transverse channels 106 extending between the respective raised portions 98.

It will be appreciated that for column-stacking, the upper rim 34 of paired box units 14 of a subjacent case construction 10 will be received within the longitudinal channels 100 which underlie the exterior side walls 20 of paired box units 14*a* and 14*b* that comprise the superposed case construction while the upper rims 34 along the ends of the case construction are received in the transverse channels 104. For cross-stacking, the upper rims 34 of the respective side walls 20 and 22 will be positionally received in appropriate transverse channels 104 and 106 in order that the case constructions 10 in alternate stack layers will be angularly displaced by ninety degrees with respect to one another.

It will be appreciated that the foregoing describes an improved form of case construction embodying separable box units suitable for the storage and transport of beverage containers, particularly bottles. It should be further appreciated that various changes in the details, materials and arrangement of parts which have herein been described and illustrated in order to explain the nature of the invention, may be made by those skilled in the art within the principle and scope of the invention as expressed in the appended claims.

I claim:

1. A case construction, comprising:

a pair of independent box units adopted for separable interconnection, said box units each having a generally rectangular bottom wall and opposed side and end walls upstanding from said bottom wall to define an open top;

each of said box units having side walls carrying connectors cooperable with those on the other box unit to restrict relative movement between said box units in directions parallel to longitudinal and transverse axes of said box units, while permitting relative movement therebetween in a direction substantially perpendicular to said longitudinal and transverse axes; and latching means carried by the end walls of each box unit including mutually alignable track means carried by adjacent end walls of united box units, and a latch member carried by the end wall of one of said box units and slidable along said track means between an unlatching position enabling relative movement in a direction perpendicular to said longitudinal and transverse axes and a latching position preventing such relative movement.

2. A case construction according to claim 1 in which said track means includes longitudinally spaced limit stops cooperable with a shoulder on said latch member for determining the latching position and the unlatching position therefor.

3. A case construction according to claim 2 in which said limit stops on said track means and said shoulder on said latch member comprise detents integrally formed on the respective elements and operable for mutual engagement in the respective positions.

4. A case construction according to claim 2 in which said latching means are disposed adjacent the upper ends of said end walls.

5. A case construction according to claim 4 in which said end walls contain grip openings adjacent said track means, and said latch member has an opening cooperable with said end wall openings in each of said latching and said unlatching positions, whereby said pair of box units can be simultaneously raised with said latch member in said latching position and individually raised with said latch member in said unlatching position.

6. A case construction according to claim 1 in which said connectors comprise a plurality of vertically extending tubular elements spaced longitudinally along the length of said associated side wall, said tubular elements including male and female members disposed along said side wall for telescoping engagement with an opposite member in the cooperating side wall of a connected box unit.

7. A case construction according to claim 6 in which each of said tubular elements comprises a male segment protruding from one surface of said side wall and a female segment protruding from the other surface of said side wall.

8. A case construction according to claim 7 including a substantially diametrically disposed partition separating said male segment of each tubular element from the female segment thereof.

9. A case construction according to claim 8 in which said diametrical partition is angularly displaced from the surfaces of said side wall.

10. A case construction according to claim 9 in which said diametrical partition is displaced at an angle of about 45 degrees with respect to said side wall surfaces.

11. A case construction according to claim 7 in which said tubular elements are substantially coextensive with the height of the associated side wall.

12. A case construction according to claim 7 in which each box unit includes a plurality of partitions upstanding from said bottom wall dividing the interior of said box unit into a plurality of container-receiving compartments, and the surface of said tubular element segment extending each into said compartment for restricting movement of a container positioned therein.

13. A case construction according to claim 12 in which said partitions include a plurality of transversely-extending partitions dividing the interior of said box unit into a plurality of compartments, each of said transversely-extending partitions having one end thereof joining said tubular element segment and the other end thereof joining an element on the opposite side wall having an arcuate sectional shape.

14. A case construction according to claim 1 in which said box unit bottom wall contains on its exterior a stack stabilizer structure comprising a plurality of outwardly projecting ribs including ribs extending parallel to, but spaced inwardly from, the bottom ends of said side and end walls, respectively, to form channels for reception of a superposed, similarly-formed case construction.

15. A case construction according to claim 14 in which said box unit has a length-to-width ratio of about 3 to 1 and ribs are arranged in three generally polygonally-shaped, mutually-spaced sets forming a channel network that includes a channel about the periphery of said box unit bottom and transverse channels intermediate a said polygonal sets dividing said bottom into thirds in the direction parallel to said walls.

16. A case construction according to claim 15 in which said box unit bottom wall is formed of a grid-like lattice upon which said stack stabilizer structure is superimposed.

17. A case construction according to claim 1 in which each of said box units are identical in configuration.

18. A case construction according to claim 17 in which said track means includes a pair of vertically spaced tracks extending horizontally across said end walls adjacent the upper end thereof, said latch member comprises a plate having horizontally-extending, vertically spaced guide ways engageable each with one of said tracks for movement therealong, and means for locating said plate on the end wall of each of said box units in a latching position bridging the interface between the side walls carrying said connecting elements.

19. A case construction according to claim 18 in which said connectors are longitudinally spaced along said interfacing side walls and each comprise a tubular element including a male segment protruding from a surface of one of said interfacing side walls and a female segment adjacent said male segment and protruding from the other surface of said interfacing side wall, an elongated slot and a substantially diametrically extending partition between said segments, said partition being angularly displaced from the surfaces of said side wall, the male segments of one of said box units being telescopically received in the female segments of the other box unit to join said box units along the interface between said interfacing side walls.

20. A case construction according to claim 19 including a plurality of transversely-extending partitions upstanding from said bottom wall dividing the interior of said box unit into a plurality of container-receiving compartments, said tubular element segments extending each into said compartments for restricting movement of a container positioned therein and each of said transversely extending partitions having one end joining a tubular element segment and the other end thereof joining an element on the opposite side wall disposed to extend similarly into said compartments for container movement-restricting purposes.

21. A case construction according to claim 19 including means forming gripping openings intermediate said vertically spaced tracks on each of said box unit end walls, and an opening in said latch member plate providing access to an adjacent gripping opening when said plate is in its unlatching position and enabling said case construction to be gripped when in the latched position.

22. A case construction according to claim 21 including cooperable detent means on said tracks and on said latch member plate operative to accurately position said latch member plate alternatively in said latching position and in said unlatching position along said tracks.

23. A case construction according to claim 22 in which said box unit has a length-to-width ratio of about 3 to 1 and the bottom wall thereof contains, on its exterior, a stack stabilizer structure comprising a plurality of outwardly projecting ribs arranged in three generally polygonally-shaped, mutually spaced sets forming a channel network for reception of a superposed, similarly formed case construction, said channel network including a channel about the periphery of said box unit bottom and transverse channels intermediate said polygonal sets dividing said bottom transversely into thirds in the direction parallel said side walls.

24. A case construction according to claim 23 in which said box unit bottom wall is formed of a grid-like lattice upon which said stack stabilizer structure is superimposed.

25. A box unit for separable connection to a corresponding box unit for assembly of a case construction, comprising:

a rectangular bottom wall and opposed side and end walls upstanding from said bottom wall to define an open top;

a plurality of connectors positioned along one of said side walls for cooperation with corresponding connectors on said corresponding box unit to restrict relative movement therebetween in directions parallel to longitudinal and transverse axes thereof while permitting relative movement therebetween in a direction substantially perpendicular to said longitudinal and transverse axes; and latching means carried by at least one end wall including transversely extending track means for alignment with corresponding track means on said corresponding box unit, and a latch member slidably received on said track means for movement between an unlatching position enabling relative movement between cooperating box units in a direction perpendicular to said longitudinal and transverse axes and a latching position preventing such relative movement.

26. A box unit according to claim 25 in which said track means includes longitudinally spaced limit stops cooperable with a shoulder on said latch member for determining the latching position and the unlatching position therefor.

27. A box unit according to claim 26 in which said limit stops on said track means and said shoulder on said latch member comprise detents integrally formed on the respective elements and operable for mutual engagement in the respective positions.

28. A box unit according to claim 26 in which said latching means are disposed adjacent the upper ends of said end walls.

29. A box unit according to claim 28 in which said end walls contain grip openings adjacent said track means, and said latch member has an opening cooperable with an end wall grip opening in each of said latching and unlatching positions whereby said box unit can be gripped for raising when separated or when assembled in a case construction.

30. A box unit according to claim 25 in which said connectors comprise a plurality of vertically extending tubular elements spaced longitudinally along the length of said associated side wall, said tubular elements including male and female members disposed along said side wall for telescoping engagement with an opposite member in the cooperating side wall of a connected box unit.

31. A box unit according to claim 30 in which each of said tubular elements comprises a male segment protruding from one surface of said side wall and a female segment protruding from the other surface of said side wall.

32. A box unit according to claim 31 including a substantially diametrically disposed partition separating said male segment of each tubular element from the female segment thereof.

33. A box unit according to claim 32 in which said diametrical partition is angularly displaced from the surfaces of said side wall.

34. A box unit according to claim 33 in which said diametrical line is displaced at an angle of about 45 degrees with respect to said side wall surfaces.

35. A box unit according to claim 31 in which said tubular elements are substantially coextensive with the height of the associated side wall.

36. A box unit according to claim 31 including a plurality of partitions upstanding from said bottom wall dividing the interior of said box unit into a plurality of container-receiving compartments, and said tubular element segment extending each into said compartment for restricting movement of a container positioned therein.

37. A box unit according to claim 36 in which said partitions include a plurality of transversely-extending partitions dividing the interior of said box unit into a plurality of compartments, each of said transversely-extending partitions having one end thereof joining said tubular element segment and the other end thereof joining an element on the opposite side wall having an arcuate sectional shape.

38. A box unit according to claim 25 in which said box unit bottom wall contains on its exterior a stack stabilizer structure comprising a plurality of outwardly projecting ribs including ribs extending parallel to, but spaced inwardly from the bottom ends of said side and end walls, respectively, to form channels for reception of a superposed, similarly formed box unit.

39. A box unit according to claim 38 in which said box unit has a length-to-width ratio of about 3 to 1 and ribs are arranged in three generally polygonally-shaped, mutually-spaced sets forming a channel network that includes a channel about the periphery of said box unit bottom and transverse channels intermediate a said polygonal sets transversely dividing said bottom into thirds in the direction parallel to said walls.

40. A box unit according to claim 39 in which said box unit bottom wall is formed of a grid-like lattice upon which said stack stabilizer structure is superimposed.

* * * * *